US007895867B2

(12) United States Patent
Hsieh

(10) Patent No.: US 7,895,867 B2
(45) Date of Patent: Mar. 1, 2011

(54) LOCK DRIVING MECHANISM

(75) Inventor: Ping-Hung Hsieh, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 0 days.

(21) Appl. No.: 12/512,659

(22) Filed: Jul. 30, 2009

(65) Prior Publication Data

US 2009/0288461 A1 Nov. 26, 2009

Related U.S. Application Data

(63) Continuation-in-part of application No. 11/277,490, filed on Mar. 25, 2006, now abandoned.

(51) Int. Cl.
*E05B 9/04* (2006.01)

(52) U.S. Cl. ..... 70/379 R; 70/372; 70/449

(58) Field of Classification Search ..... 70/372, 70/373, 375, 379 R, 380, 449
See application file for complete search history.

(56) References Cited

U.S. PATENT DOCUMENTS 3,286,773 A * 11/1966 Russell et al. ..... 70/371
3,404,549 A * 10/1968 Best ..... 70/370
3,541,820 A * 11/1970 Best ..... 70/369
5,377,511 A * 1/1995 Meckbach ..... 70/38 A
6,109,080 A 8/2000 Chen et al.
6,145,356 A * 11/2000 Thwing ..... 70/389
6,644,076 B2 11/2003 Huang
6,758,075 B1 7/2004 Thwing
6,883,356 B1 4/2005 Wu
7,003,994 B2 2/2006 Ruan
2005/0199027 A1 * 9/2005 Mannella ..... 70/379 R

* cited by examiner

*Primary Examiner*—Suzanne D Barrett
*Assistant Examiner*—Christopher Boswell
(74) *Attorney, Agent, or Firm*—Muncy, Geissler, Olds & Lowe, PLLC

(57) ABSTRACT

A lock driving mechanism for use in a lock has an inner driving member having an inner panel, and an outer driving member attached to the inner panel and having an outer panel. The inner panel has an inner surface from which a lock core driver extends and connects to a lock core assembly of the lock and an outer surface on which an inner driver and an outer driver are formed. The outer panel has an inner surface on which an inner limiting protrusion and an outer limiting protrusion are formed, and an outer surface from which a latch driver extends to connect with a latch bolt of the lock. When a key inserted into the lock core assembly rotates, the inner and outer driver rotate, synchronously push the inner and outer bump, respectively, to make the key and latch driver rotate smoothly to drive the latch bolt to lock or unlock a door.

8 Claims, 7 Drawing Sheets

LOCK DRIVING MECHANISM

CROSS REFERENCE TO RELATED APPLICATIONS

This application is a Continuation-in-Part of application Ser. No. 11/277,490, filed on Mar. 25, 2006, now abandoned and for which priority is claimed under 35 U.S.C. §120, the entire contents of which are hereby incorporated by reference.

BACKGROUND OF THE INVENTION

1. Field of the Invention

The present invention relates to a lock, and more particularly to a lock driving mechanism for use in a lock.

2. Description of the Related Art

A unique key is used to unlock a corresponding lock. Sometimes, the key has to be changed, which necessitates changing the entire lock. For a common example, a landlord usually has to change door locks when a tenant moves out and a new tenant moves in. Changing the entire lock is not economical, so a lock with a replaceable lock core assembly was invented. When the key is changed, changing the whole lock is not necessary and replacing the lock core is more economical.

With reference to FIGS. 6-8, a lock has a cylindrical housing (60), a lock core assembly (not shown), a round panel (66), a lock driving mechanism (61), a spring (65), a fastening bracket (64) and a latch bolt (not shown).

The cylindrical housing (60) is hollow, is mounted in a door (not shown) and has an inner surface (not numbered) and a receiving hole (601). The receiving hole (601) is defined in the inner surface of the cylindrical housing (60).

The lock core assembly is held rotatably in the cylindrical housing (60), and a corresponding key can be inserted into and rotate the lock core assembly.

The round panel (66) is held rotatably in the receiving hole (601) and has a slot (661). The slot (661) is defined in the round panel (66).

The lock driving mechanism (61) has an inner driving member (62) and an outer driving member (63).

The inner driving member (62) has an inner panel (621) and two inner arms (622). The inner panel (621) has two shoulders (623), a head (624), an inner surface (not numbered) and an outer surface (not numbered). The head (624) protrudes between the shoulders (623) and has two sides (not numbered). The inner surface of the inner panel (621) abuts the round panel (66). The inner arms (622) extend laterally from the two sides of the head (624), insert through the slot (661) of the round panel (66) and is connected with the lock core assembly inside the cylindrical housing (60). When the corresponding key inserts into the lock core assembly, the corresponding key inserts between the two inner arms (622). Further, rotating the corresponding key rotates the inner arms (622) and inner panel (621) in the meanwhile.

The outer driving member (63) has an outer panel (631), a bulge (633) and an outer arm (632). The outer panel (631) has an inner surface (not numbered) and an outer surface (not numbered). The bulge (633) protrudes laterally from the inner surface of the outer panel (631). The outer arm (632) extends laterally from the outer surface of the outer panel (631). When the inner panel (621) rotates, one of the shoulders pushes the bulge (633) to rotate the outer panel (631) and outer arm (632). The inner surface of the outer panel (631) abuts the outer surface of the inner panel (321).

The spring is put around the outer arm (632) of the outer driving member (63) to make the inner surface of the outer panel (631) abut the outer surface of the inner panel (621).

The fastening panel (64) is mounted on the inner surface of the cylindrical housing (60) and defines a through hole (641). The outer arm (632) extends through the through hole (641).

The latch bolt is connected to the outer arm (632) of the outer driving member (63) outside the cylindrical housing (60). The rotary outer arm (632) controls the latch bolt to lock or unlock the door.

Rotating the corresponding key can extend or retract the latch bolt lock. However, in the rotating process of the lock driving mechanism (61), only one of the shoulders (623) pushes the bulge (633) to rotate the outer driving member (63). Thus, a moment imposed by one of the shoulders (623) only concentrates on the bulge (633) but not distributes symmetrically over the outer panel (631). The moment is irregular and cannot make the outer panel (631) rotate smooth.

SUMMARY OF THE INVENTION

The primary objective of the present invention is to provide a lock driving mechanism to connect a lock core assembly to a latch bolt of a lock, to smoothly drive the latch bolt.

The lock driving mechanism in accordance with the present invention is held in a cylindrical housing of the lock.

The cylindrical housing is mounted in a door and has an inner surface and a receiving hole. The receiving hole is defined in the inner surface of the cylindrical housing.

The lock driving mechanism is held rotatably in the receiving hole of the cylindrical housing and has an inner driving member and an outer driving member.

The inner driving member has an inner panel, a lock core driver, an inner driver and an outer driver. The inner panel has a center, an imaginary inner circle, an imaginary outer circle, an inner surface and an outer surface. The imaginary inner circle and imaginary outer circle are concentric circles centered at the center of the inner panel. The lock core driver has at least one inner arm extending from the inner surface of the inner panel and being connected with the lock core assembly. The inner driver has two stop portions formed on the outer surface on the imaginary inner circle of the inner panel. The outer driver has two stop portions formed on the outer surface on the imaginary outer circle of the inner panel.

The outer driving member engages the inner driving member and has an outer panel, an inner bump, an outer bump and a latch driver. The outer panel has a center, an imaginary inner circle, an imaginary outer circle, an inner surface and an outer surface. The center of the outer panel corresponds to the center of the inner panel. The imaginary inner circle and imaginary outer circle on the outer panel correspond to the imaginary inner circle and imaginary outer circle on the inner panel. The inner bump is formed on the inner surface on the imaginary inner circle on the outer panel. The outer bump is formed on the inner surface on the imaginary outer circle on the outer panel. The latch driver has at least one outer arm extending from the outer surface of the outer panel. The at least one outer arm is connected to and extends or retracts the latch bolt.

When a corresponding key inserted into the lock core assembly is turned, the lock core driver rotates such that one of the inner stop portions of the inner driver and one of the outer stop portions of the outer driver rotate to synchronously push the inner bump and outer bump, respectively. Thus, a moment generated by the rotating corresponding key is divided between the inner bump and outer bump, to make the corresponding key and latch driver rotate smoothly to drive the latch bolt to lock or unlock the door.

DETAILED DESCRIPTION OF THE PREFERRED EMBODIMENT

A lock driving mechanism in accordance with the present invention is used in a lock with a replaceable lock core assembly.

Figure 1:
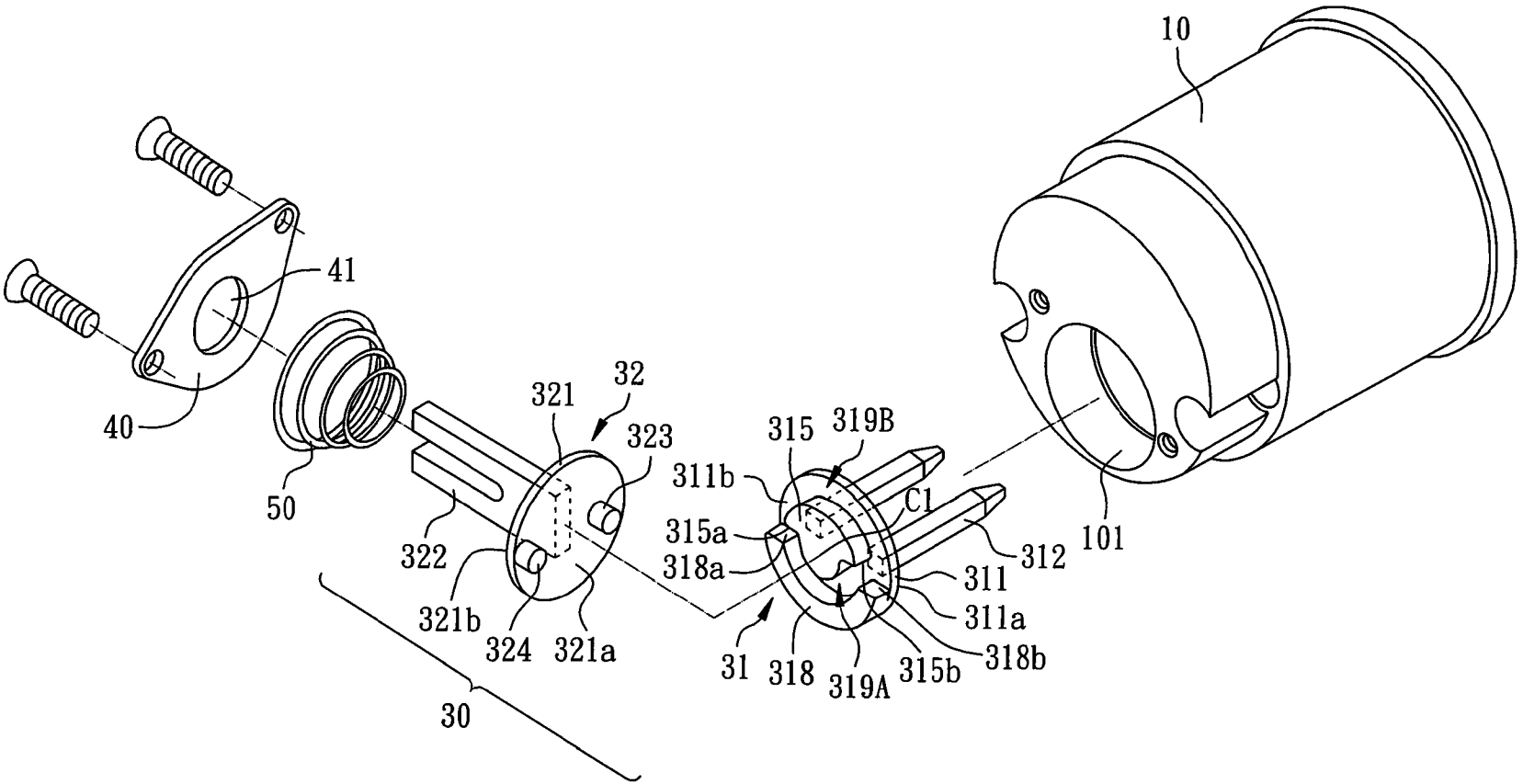
FIG. 1 is an exploded perspective view of a first embodiment of the lock driving mechanism in accordance with the present invention.
Figure 4:
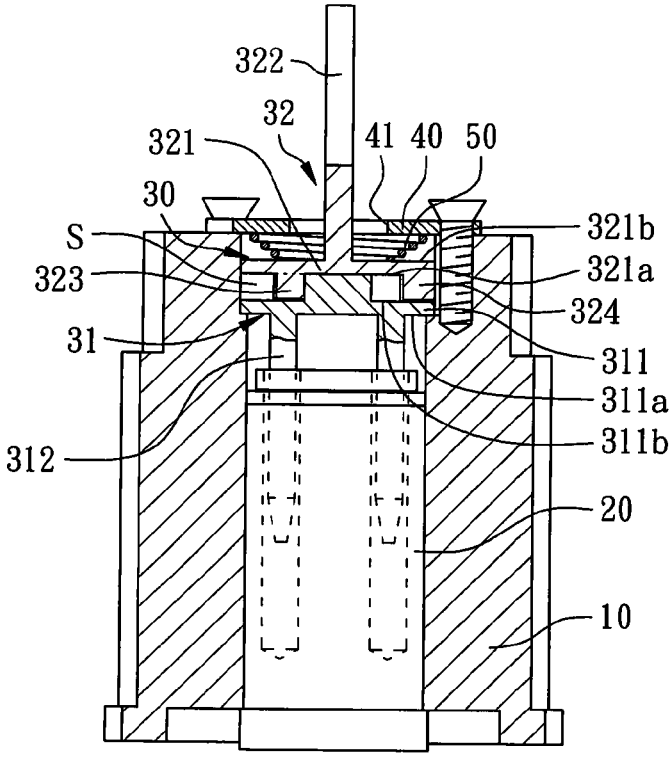
FIG. 4 is a top view in partial section of the lock driving mechanism along line A-A in FIG. 3.
Figure 5:
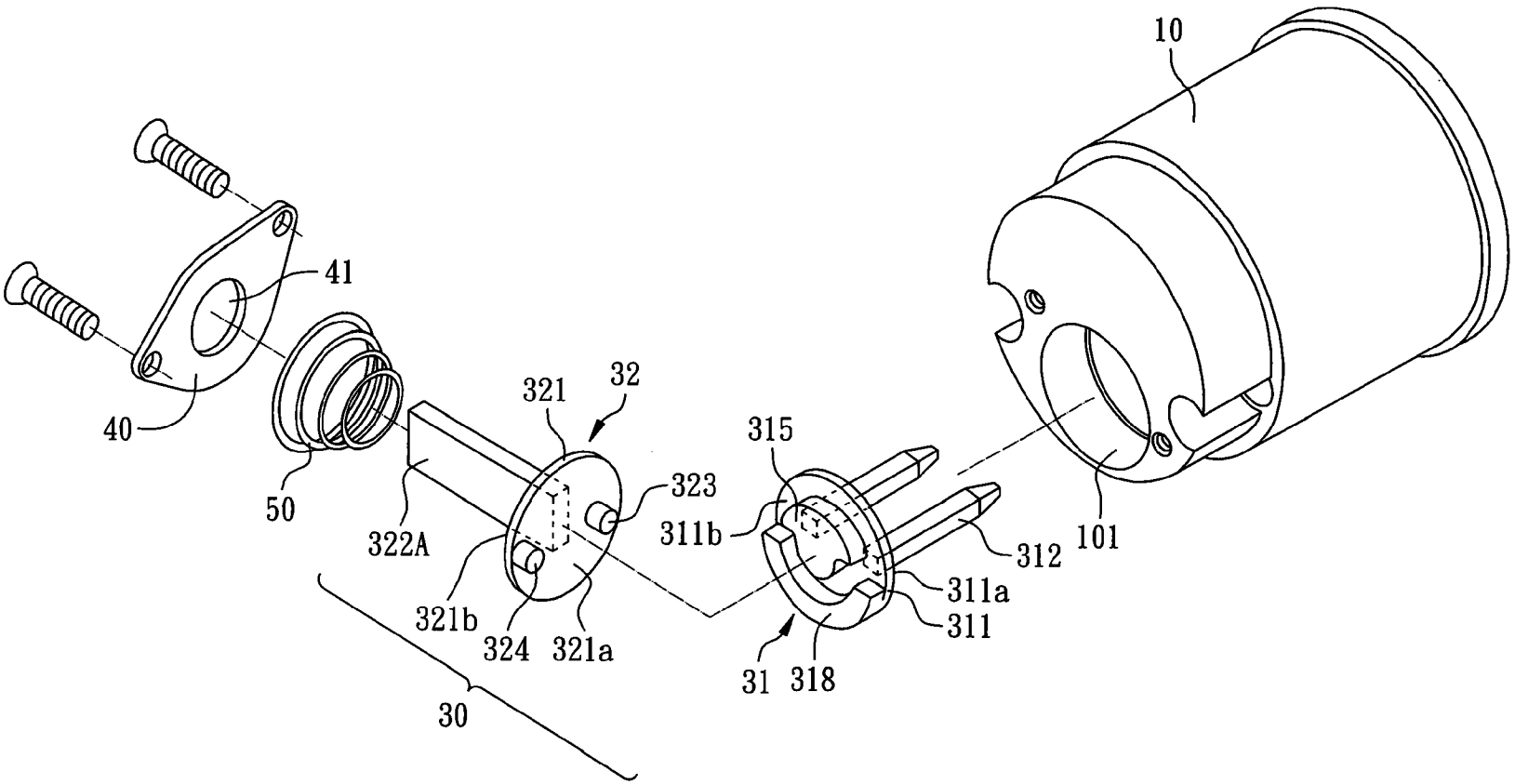
FIG. 5 is an exploded perspective view of a second embodiment of the lock driving mechanism in accordance with the present invention.
Figure 6:
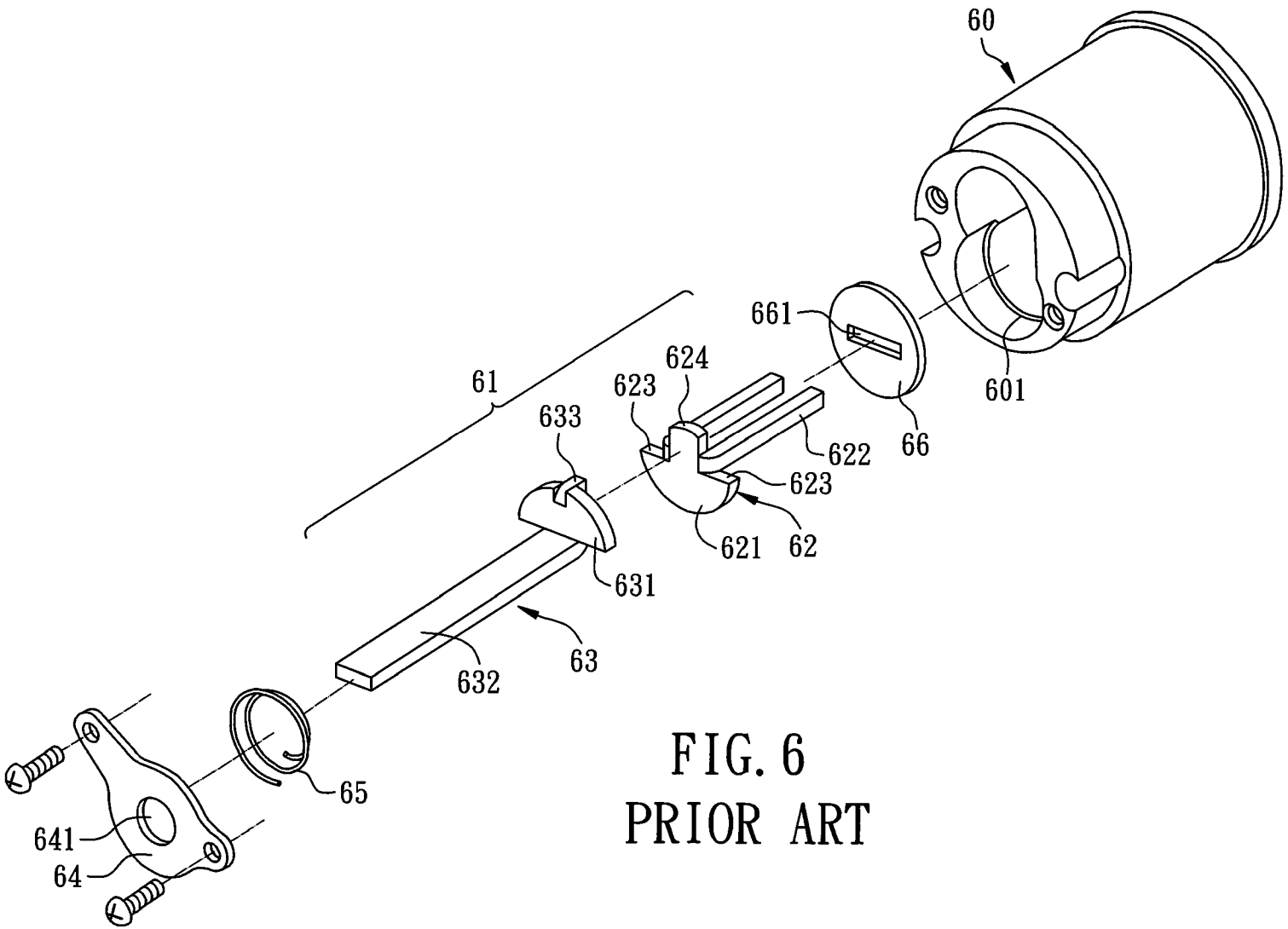
FIG. 6 PRIOR ART
FIG. 6 is an exploded perspective view of a conventional lock driving mechanism in accordance with the prior art.
Figure 7:
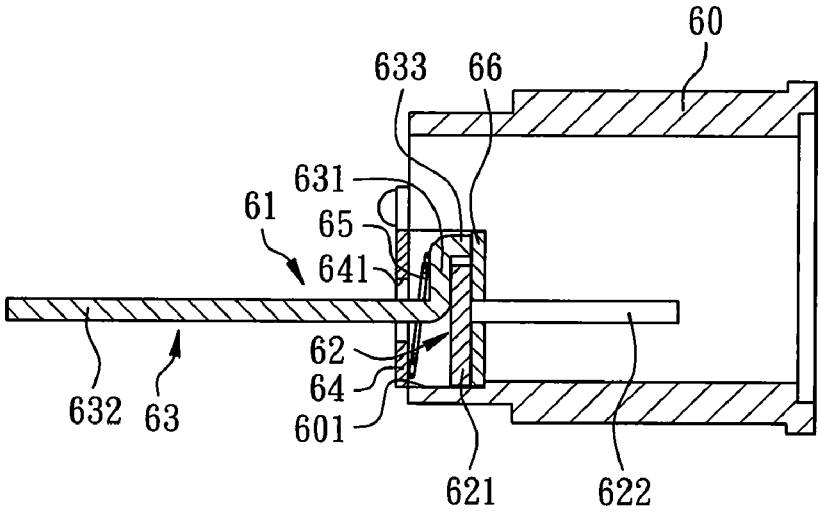
FIG. 7 PRIOR ART
FIG. 7 is a side view in partial section of the conventional lock driving mechanism in FIG. 6.
Figure 8:
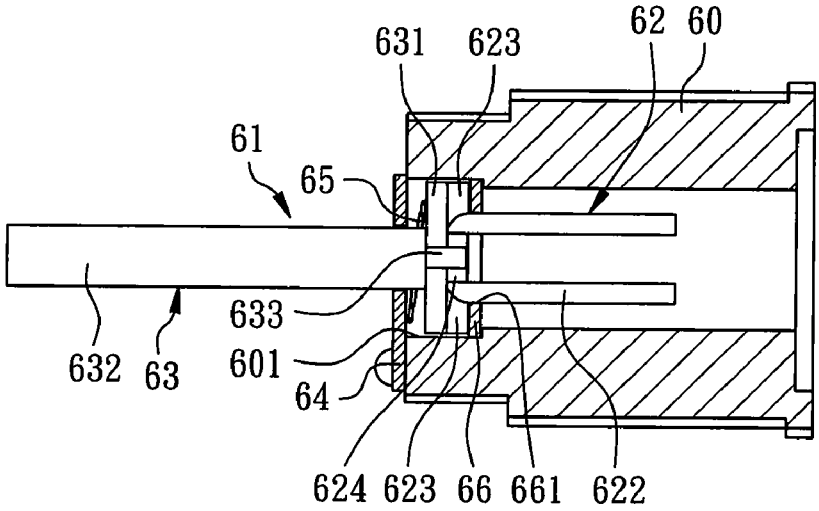
FIG. 8 PRIOR ART
FIG. 8 is a top view in partial section of the conventional lock driving mechanism in FIG. 6.

With reference to FIGS. 1, 4 and 5, a lock comprises a cylindrical housing (10), a lock core assembly (20), a lock driving mechanism (30), a spring (50), a fastening panel (40) and a latch bolt.

The cylindrical housing (10) is hollow, is mounted in a door and has an inner surface and a receiving hole (101). The receiving hole (101) is defined in the inner surface of the cylindrical housing (10).

The lock core assembly (20) is held rotatably in the cylindrical housing (10) and allows a corresponding key to be inserted into and rotate the lock core assembly (20).

The lock driving mechanism (30) is held rotatably in the receiving hole (101) of the cylindrical housing (10), connects to the lock core assembly (20), protrudes from the receiving hole (101) and has an inner driving member (31) and an outer driving member (32).

The inner driving member (31) is held rotatably in the receiving hole (101) of the cylindrical housing (10) and has an inner panel (311), a lock core driver (312), an inner driver (315) and an outer driver (318), wherein the inner panel (311), the lock core driver (312), the inner driver (315) and the outer driver are monolithic.

Figure 2:
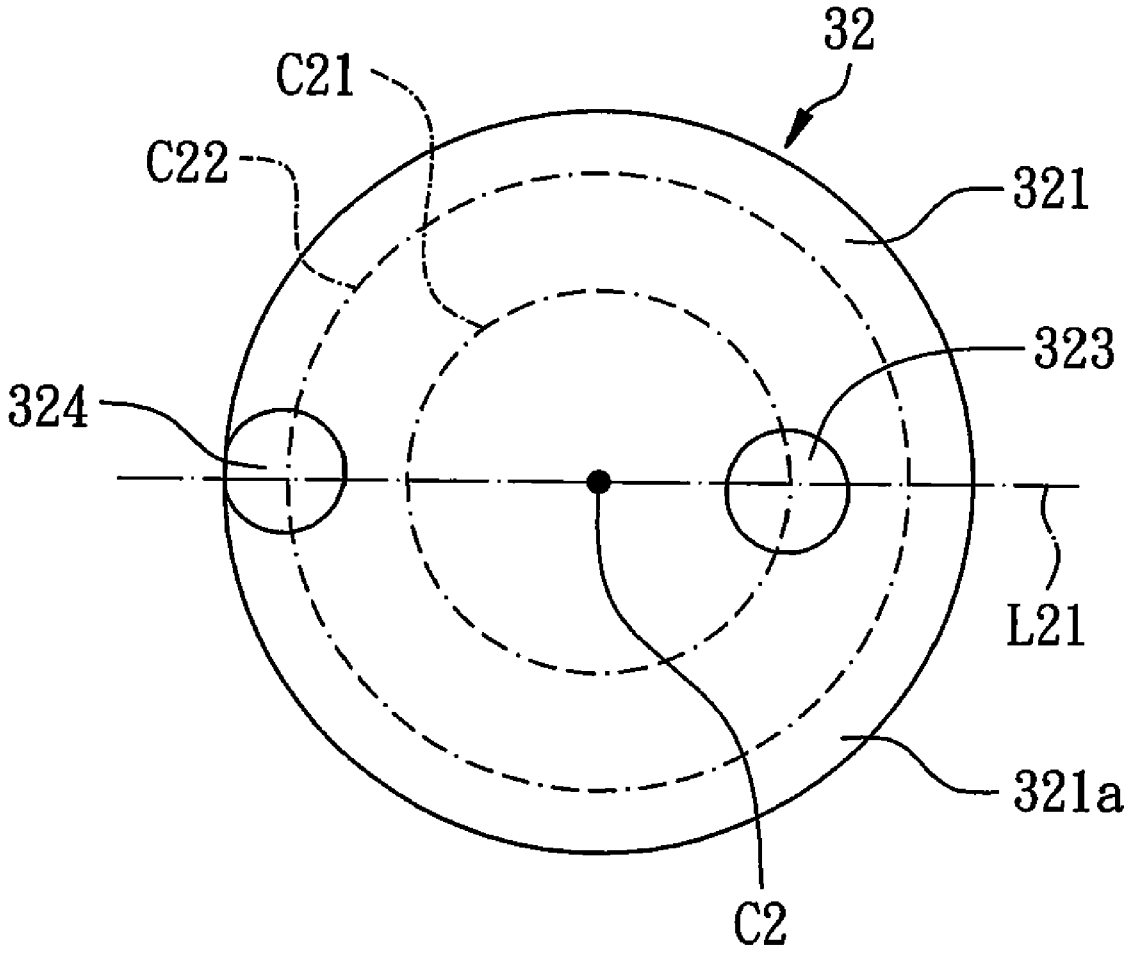
FIG. 2 is a side view of an outer driving member.
Figure 3:
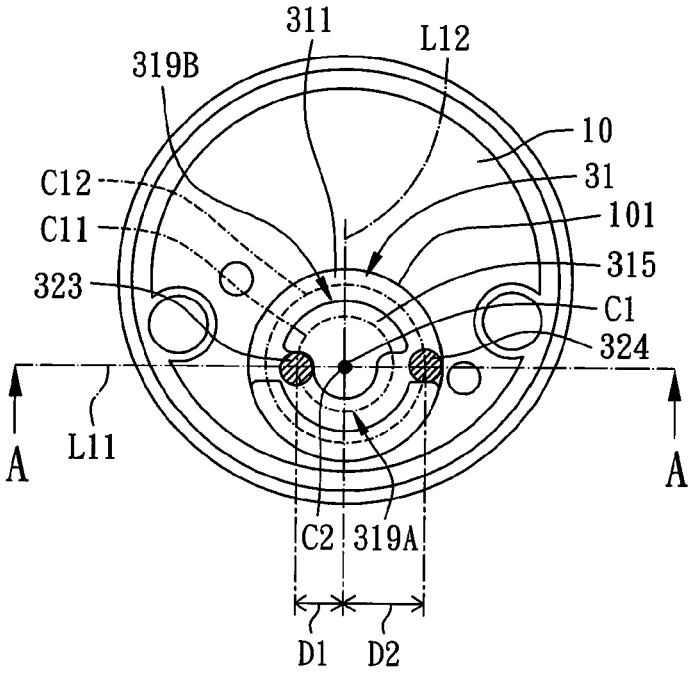
FIG. 3 is a cross-sectional rear view of the lock driving mechanism in FIG. 1.

With further reference to FIGS. 1, 2 and 3, the inner panel (311) is held rotatably in the receiving hole (101) and has an inner surface (311*a*), an outer surface (311*b*), a center (C1), a first axis (L11), a second axis (L12), an imaginary inner circle (C11) and an imaginary outer circle (C12). The first axis (L11) and second axis (L12) intersect at the center (C1) of the inner panel (311) and are perpendicular to each other. The imaginary inner circle (C11) and imaginary outer circle (C12) are concentric circles centered at the center (C1) of the inner panel (311).

The lock core driver (312) has at least one inner arm extending from the inner surface (311*a*) of the inner panel (311) through the receiving hole (101) in the cylindrical housing (10) and being connected to the lock core assembly (20). When a key corresponding to the lock core assembly (20) is inserted into the lock core assembly (20) and is turn, the at least one arm of the lock core driver (312) is rotated to rotate the inner panel (311). One implementation of the lock core driver (312) has two inner arms. The two inner arms extend from the inner surface (311*a*) of the inner panel (311) through the receiving hole (101) in the cylindrical housing (10) and are connected to the lock core assembly (20). A key corresponding to the lock core assembly (20) is inserted into the lock core assembly (20) between the two inner arms. Turning the corresponding key simultaneously rotates the inner arms and inner panel (311).

The inner driver (315) has two inner stop portions (315*a*, 315*b*) formed on and protruding from the outer surface (311*b*) of the inner panel (311) and located on the imaginary inner circle (C11) of the inner panel (311) and being symmetric relative to the second axis (L12), and may be implemented in several ways.

With reference to FIGS. 1, 3 and 5, an implementation of the inner driver (315) is one piece or monolithic and has a major semicircular body and a minor semicircular body. The major semicircular body is formed on the outer surface of the inner panel (311) above the first axis (L11), forms an upper semicircular track (319B) between the major semicircular body and the receiving hole (101) and has two shoulders. The shoulders align with the imaginary inner circle (C11) of the inner panel (311) above the first axis (L11) and are symmetric relative to the second axis (L12). The minor semicircular body extends downward between the shoulders. The two inner stop portions (315*a*, 315*b*) are formed respectively on the shoulders of the major semicircular body.

The outer driver (318) has two outer stop portions (318*a*, 318*b*) formed on and protruding from the outer surface (311*b*) of the inner panel (311), located on the imaginary outer circle (C12) of the inner panel (311) and being symmetric relative to the second axis (L12) and may be implemented in several ways.

With reference to FIGS. 1, 3 and 5, an implementation of the outer driver (318) is a semicircular ring, is one piece or monolithic, is formed below the first axis (L11), forms a lower semicircular track (319A) between the minor semicircular body and the semicircular ring and has two ends located on the imaginary outer circle of the inner panel and symmetric relative to the second axis (L12). The two stop portions are formed respectively on the ends of the semicircular ring.

Figure 9:
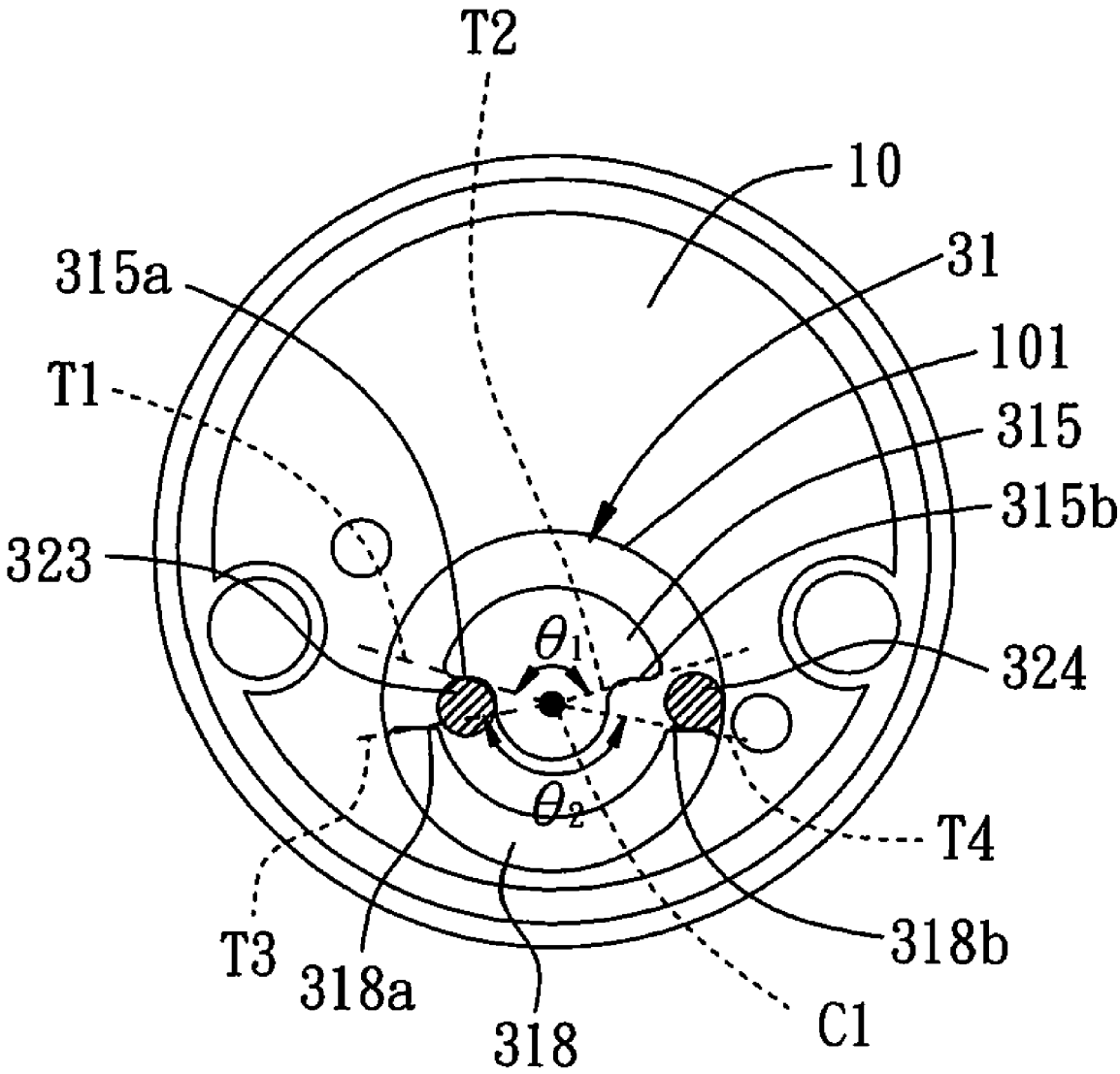
FIG. 9 is another cross-sectional rear view of the lock driving mechanism in FIG. 1.

With further reference to FIG. 9, in this embodiment, there are a first defined line T1 penetrating the center (C1) of the inner panel (311) and the inner stop portion 315*a* of the inner driver (315), a second defined line T2 penetrating the center (C1) of the inner panel (311) and the inner stop portion 315*b* of the inner driver (315), a third defined line T3 penetrating the center (C1) of the inner panel (311) and the outer stop portion 318*a* of the outer driver (318) and a forth defined line T4 penetrating the center (C1) of the inner panel (311) and the outer stop portion 318*b* of the outer driver (318), wherein there are a first included angle $\theta_1$ formed between the first defined line T1 and the second defined line T2 and a second included angle $\theta_2$ formed between the third defined line T3 and the forth defined line T4, preferably, the second included angle $\theta_2$ is not equal to the first included angle $\theta_1$.

The outer driving member (32) is held rotatably in the receiving hole (101) of the cylindrical housing (10), abuts, engages and is rotated by the inner driving member (31) and has an outer panel (321), an inner bump (323), an outer bump (324) and a latch driver (322, 322A).

With further reference to FIGS. 1, 2 and 3, the outer panel (321) is held rotatably in the receiving hole (101) and has an inner surface (321*a*), an outer surface (321*b*), a center (C2), a dividing axis (L21), an imaginary inner circle (C21) and an imaginary outer circle (C22). The center (C2) of the outer panel (321) corresponds to the center (C1) of the inner panel (311). The dividing axis (L21) passes through the center (C2) of the outer panel (321). The imaginary inner circle (C21) and imaginary outer circle (C22) on the outer panel (321) correspond respectively to the imaginary inner circle (C11) and imaginary outer circle (C12) on the inner panel (311).

The inner bump (323) is formed on and protruding from the inner surface (321*a*) of the outer panel (321) and located on the imaginary inner circle (C11) of the inner panel (311). Besides, there is a first interval (D1) between the center (C2) and the inner bump (323).

The outer bump (324) is formed on and protruding from the inner surface (321*a*) of the outer panel (321), located on the imaginary outer circle (C12) and opposite to the inner bump (323). Besides, there is a second interval (D2) between the center (C2) and the outer bump (324), in this embodiment, the second interval (D2) is greater than the first interval (D1).

With further reference to FIGS. 1 and 4, in this embodiment, the inner bump (323) and the outer bump (324) are located between the outer surface (311*b*) of the inner panel (311) and the inner surface (321*a*) of the outer panel (321). There is a space (S) formed between the outer surface (311*b*) of the inner panel (311) and the inner surface (321*a*) of the outer panel (321). The inner bump (323) and the outer bump (324) are capable of being moved within the space (S).

The outer panel (321) engages and is rotated by the inner panel (311) by one of the two inner stop portions (315*a*, 315*b*) of the inner driver (315) abutting and pushing the inner bump (323). Simultaneously, one of the two outer stop portions (318*a*, 318*b*) of the outer driver (318) abuts and pushes the outer bump (324). One of the inner stop portions (315*a*, 315*b*) and one of the outer stop portions (318*a*, 318*b*) abut simultaneously the inner bump (323) and outer bump (324) to rotate the outer panel (321) smoothly.

With further reference to FIGS. 1, 3 and 5, the outer panel (321) engages and is rotated by the inner panel (311) by the inner bump (323) on the outer panel (321) sliding in the lower semicircular track (319A) and being abutted and pushed by one of the shoulders on the inner driver (315) on the inner panel (311). Simultaneously, the outer bump (324) slides in the upper semicircular track (319B) and is abutted and pushed by one end of the outer driver (318) on the inner panel (311), which generates a moment around the center (C2) of the outer panel (321) and rotates the outer panel (321).

The latch driver (322, 322A) has at least one outer arm extending from the outer surface (321*b*) of the outer panel (321) and may be implemented in several ways.

With reference to FIG. 1, a first implementation of the latch driver (322) has two outer arms extending from the outer surface (321*b*) of the outer panel (321) and may be used with a lock having two keyholes in opposite ends of a lock.

With reference to FIG. 5, a second implementation of the latch driver (322A) only has a one-piece outer arm extending from the outer surface (321*b*) of the outer panel (321) and may be used with a lock having a single keyhole.

The spring (50) is mounted around the latch driver (322, 322A) against the outer panel (321) and presses the outer panel (321) against the inner panel (311).

The fastening panel (40) is attached to the inner surface of the cylindrical housing (10), holds the spring (50) against the outer panel (321) and has a through hole (41). The through hole (41) allows the latch driver (322, 322A) of the outer driving member (32) to protrude from the cylindrical housing (10).

The latch bolt is connected to the latch driver (322, 322A) of the outer driving member (32) outside the cylindrical housing (10). The latch bolt is extended or retracted to respectively lock or unlock the door by rotating the latch driver (322, 322A).

When the corresponding key is inserted into the lock core assembly and rotated, the inner driver (315) and outer driver (318) of the inner panel (311) rotate to synchronously engage and push the inner bump (323) and outer bump (324), respectively. Thus, a moment generated by the rotating corresponding key is divided between the inner bump (323) and outer bump (324), to make the corresponding key and latch driver (322, 322A) rotate smoothly to drive the latch bolt to lock or unlock the door.

What is claimed is:

1. A lock driving mechanism for use in a lock having a cylindrical housing having a hollow receiving hole with an axial direction, the lock driving mechanism held rotatably in the hollow receiving hole, and a fastening member mounted to the cylindrical housing to hold the lock driving mechanism in the hollow receiving hole, said lock driving mechanism comprising:

an inner driving member having an inner panel, said inner panel including an inner surface, an outer surface, a center, an imaginary inner concentric circle and an imaginary outer concentric circle being provided on said outer surface of said inner panel;

a lock core driver having at least one inner arm extending from said inner surface of said inner panel;

an inner driver having two inner stop portions formed on and protruding in the axial direction from said outer surface of said inner panel, said two inner stop portions being located on a track of said imaginary inner concentric circle of said outer surface of said inner panel;

an outer driver having two outer stop portions formed on and protruding in the axial direction from said outer surface of said inner panel, said two outer stop portions being located on a track of said imaginary outer concentric circle of said outer surface of said inner panel, wherein said inner panel, said lock core driver, said inner driver and said outer driver are monolithic, a lower semicircular track is between said inner driver and said outer driver, and an upper semicircular track is located outside of said inner driver;

an outer driving member coupled to said inner driving member and having an outer panel, said outer panel including an inner surface, an outer surface and a center;

an inner bump formed on and protruding in the axial direction from said inner surface of said outer panel;

an outer bump formed on and protruding in the axial direction from said inner surface of said outer panel; and a latch driver having at least one outer arm extending from said outer surface of said outer panel;

wherein said inner bump on said inner surface of said outer panel is located on a rotating track corresponding to said imaginary inner concentric circle of said outer surface of said inner panel when said outer panel is coupled to said inner panel;

wherein said outer bump on said inner surface of said inner panel is located on a rotating track corresponding to said imaginary outer concentric circle of said outer surface of said inner, panel when said outer panel is coupled to said inner panel;

wherein said inner bump and said outer bump are located between said outer surface of said inner panel and said inner surface of said outer panel, there is a space formed between said outer surface of said inner panel and said inner surface of said outer panel, said inner bump and said outer bump are capable of being moved within said space; and wherein said inner stop portions of said inner driver and said outer stop portions of said outer driver are adapted to rotate said inner bump and outer bump respectively;

wherein said inner driving member is circular disk shaped with said inner driver and said outer driver protruding in the axial direction.

2. The lock driving mechanism as claimed in claim 1, wherein said inner driver has a major semicircular body formed on said outer surface of said inner panel and having two shoulders aligning with said track of said imaginary inner concentric circle of said inner panel, wherein said inner stop portions are located on said shoulders respectively; and a minor semicircular body extending downward between the shoulders.

3. The lock driving mechanism as claimed in claim 1, wherein said outer driver includes two outer protruding sections formed on said outer surface of said inner panel and protruding in the axial direction and located on said track of said imaginary outer concentric circle of said inner panel; and said outer stop portions are located on said outer protruding sections respectively.

4. The lock driving mechanism as claimed in claim 1, wherein said outer driver is a semicircular ring, and has two ends located on said track of said imaginary outer concentric circle of said inner panel; and said outer stop portions of said outer driver are located on said two ends respectively.

5. The lock driving mechanism as claimed in claim 1, wherein said latch driver has a single outer arm extending from said outer surface of said outer panel.

6. The lock driving mechanism as claimed in claim 1, wherein there is a first interval between said center of said outer panel and said inner bump and there is a second interval between said center of said outer panel and said outer bump, said second interval is greater than said first interval.

7. The lock driving mechanism as claimed in claim 1, wherein there are a first defined line penetrating the center of the inner panel and one of the inner stop portions, a second defined line penetrating the center of the inner panel and another one of the inner stop portions, a third defined line penetrating the center of the inner panel and one of the outer stop portions and a fourth defined line penetrating the center of the inner panel and another one of the outer stop portions, wherein there are a first included angle formed between the first defined line and the second defined line and a second included angle formed between the third defined line and the fourth defined line, the second included angle is not equal to the first included angle.

8. The lock driving mechanism as claimed in claim 1, wherein said outer driving member is circular disk shaped with said inner and outer bumps extending in the axial direction.

* * * * *